US008235136B2

(12) United States Patent
Berger et al.

(10) Patent No.: US 8,235,136 B2
(45) Date of Patent: Aug. 7, 2012

(54) DRILLING AND/OR PERCUSSIVE HAMMER WITH NO-LOAD OPERATION CONTROL

(75) Inventors: Rudolf Berger, Grunwald (DE); Wolfgang Schmid, Filderstadt (DE)

(73) Assignee: Wacker Neuson Produktion GmbH & Co. KG, Munich (DE)

( * ) Notice: Subject to any disclaimer, the term of this patent is extended or adjusted under 35 U.S.C. 154(b) by 590 days.

(21) Appl. No.: 11/917,988

(22) PCT Filed: Jun. 21, 2006

(86) PCT No.: PCT/EP2006/005978

§ 371 (c)(1),
(2), (4) Date: Mar. 18, 2010

(87) PCT Pub. No.: WO2006/136401

PCT Pub. Date: Dec. 28, 2006

(65) Prior Publication Data

US 2010/0163260 A1 Jul. 1, 2010

(30) Foreign Application Priority Data

Jun. 22, 2005 (DE) ..... 10 2005 028 918

(51) Int. Cl.
*B25D 11/04* (2006.01)

(52) U.S. Cl. ..... 173/2; 173/48; 173/109; 173/201

(58) Field of Classification Search ..... 173/2, 48, 173/109, 104, 201, 135, 212
See application file for complete search history.

(56) References Cited

U.S. PATENT DOCUMENTS

| | | | | |
|---|---|---|---|---|
| 2,814,277 | A * | 11/1957 | Jimerson | 173/176 |
| 3,480,090 | A * | 11/1969 | Kotone | 173/135 |
| 3,835,935 | A | 9/1974 | Sides et al. | |
| 4,611,670 | A | 9/1986 | Chromy | |
| 5,873,418 | A | 2/1999 | Arakawa et al. | |
| 5,879,111 | A * | 3/1999 | Stock et al. | 408/6 |
| 6,209,659 | B1 * | 4/2001 | Blessing | 173/201 |
| 6,237,700 | B1 * | 5/2001 | Berger et al. | 173/201 |
| 6,415,875 | B1 * | 7/2002 | Meixner et al. | 173/2 |
| 6,672,403 | B2 * | 1/2004 | Ahr et al. | 173/1 |
| 6,681,869 | B2 * | 1/2004 | Wursch et al. | 173/2 |
| 6,843,327 | B2 * | 1/2005 | Meixner et al. | 173/11 |
| 7,165,305 | B2 * | 1/2007 | Kenney et al. | 29/434 |
| 7,306,046 | B2 * | 12/2007 | Meixner et al. | 173/2 |
| 7,628,219 | B2 * | 12/2009 | Frauhammer et al. | 173/18 |
| 2004/0003930 | A1 | 1/2004 | Meixner et al. | |

FOREIGN PATENT DOCUMENTS

| | | | |
|---|---|---|---|
| DE | 2641070 | A1 | 3/1978 |
| DE | 3707051 | A1 | 9/1988 |
| DE | 10145464 | A1 | 4/2003 |
| EP | 0599537 | A1 | 6/1994 |
| GB | 942668 | | 11/1963 |

* cited by examiner

*Primary Examiner* — Scott A. Smith
(74) *Attorney, Agent, or Firm* — Boyle Fredrickson, S.C.

(57) ABSTRACT

A drilling and/or percussive hammer comprises a handle and a hammer housing, which can move relative to the handle and inside of which, among other things, a pneumatic spring percussive mechanism is housed. The pneumatic spring of the pneumatic spring percussive mechanism can be ventilated via a no-load operation duct that is opened and closed by a valve. The valve can be opened and closed according to a pressing force acting upon the handle. A delay device controls the valve during closing so that the valve reaches the position corresponding to the detected pressing force only with a time delay. This causes a smooth transition from the no-load operation to the percussive operation.

29 Claims, 5 Drawing Sheets

DRILLING AND/OR PERCUSSIVE HAMMER WITH NO-LOAD OPERATION CONTROL

BACKGROUND OF THE INVENTION

1. Field of the Invention

The present invention relates to a drilling and/or percussive hammer having no-load operation control according to the preamble of patent claim 1.

2. Description of the Related Art

Such a drilling and/or percussive hammer (hereinafter simply called "hammer") having an application pressure-dependent no-load operation control is known from DE 101 45 464 A1. There, the hammer has a no-load channel for connecting a hollow space, formed between a drive piston and a percussion piston in a pneumatic spring percussion mechanism, to the surrounding environment, said channel being capable of being opened and closed by a valve. In the flow of force between the grip point of the handle and the hammer housing, there is situated an acquisition device for acquiring an application force that can be applied to the handle by the operator. The valve can be controlled dependent on the acquired application force.

The resulting advantages are described in detail in DE 101 45 464 A1. In particular, in this way it is possible for the operator to place the hammer at first gently onto the stone that is to be worked, even if the motor is already activated, and therefore has an increased rotational speed. In this state, the percussion mechanism is still in no-load operation, even if the drive piston in the percussion mechanism is already moved back and forth. The valve is not actuated, with closing of the no-load channel, until the application force is increased by the operator, whereupon an air spring can form in the hollow space between the drive piston and the percussion piston. In this way, percussion operation begins.

The hammer described in DE 101 45 464 A1 has proved its usefulness in practice. However, it has turned out that the design described there can be further improved. In particular, due to the fact that during the transition from no-load operation to percussion operation the hammer carries out certain intrinsic movements due to the actuation of the pneumatic spring percussion mechanism and the oscillations that arise therefrom, so that the hammer housing moves relative to the handle held by the operator, it is possible for the valve to close prematurely, so that in the end percussion operation begins suddenly, in a manner that is not anticipated by the operator.

OBJECT OF THE INVENTION

The object of the present invention is to improve a hammer of the general type described in such a way that a soft application of the hammer can be achieved through a relatively slow transition from no-load operation to percussion operation.

The solution of this problem according to the present invention is indicated in patent claim 1. Advantageous developments of the present invention are defined in the dependent claims.

A drilling and/or percussive hammer according to the present invention (simply called "hammer" below) has a valve with which a hollow space situated in the pneumatic spring percussion mechanism and fashioned in order to accommodate an air spring can be brought into connection with the surrounding environment via a no-load channel. The valve is used to open the no-load channel in no-load operation and to close the no-load channel in percussion operation. In addition, an acquisition device is provided for the acquisition of a control quantity that distinguishes between percussion operation and no-load operation. The valve is capable of being opened and closed dependent on the control quantity, and for this purpose assumes a position corresponding to the control quantity. For this purpose, it can be useful to define a boundary value upon the overshooting or undershooting of which the position corresponding to percussion operation or to no-load operation is assumed.

According to the present invention, a delay device is provided via which during closing the valve can be controlled in such a way that it reaches the position corresponding to the acquired control quantity with a time delay.

As stated above, the closing of the no-load channel by the valve brings about a transition of the pneumatic spring percussion mechanism from no-load operation to percussion operation, because an air spring can then form in the hollow space between the drive piston and the percussion piston. The delay device brings it about that even when the hammer is applied abruptly, or even if there is an increase in the acquired application pressure due to an undesired or unpredictable intrinsic movement of the hammer housing, there nonetheless does not take place an immediate closing of the no-load channel by the valve, corresponding in this case to the increased application pressure. Rather, the valve changes its position in a manner that extends over time, independent of such short-term effects, and assumes the position corresponding to the acquired control quantity only after a certain period of time has elapsed. This has the result that the transition from no-load operation to percussion operation takes place in a relatively gentle manner that can be anticipated by the operator.

Advantageously, in contrast, during opening the valve can be controlled in such a way that it essentially immediately reaches a position that corresponds to one of the acquired control quantities, e.g. the application pressure. The opening of the no-load channel is necessary during the transition from percussion operation to no-load operation, and is achieved by lifting the hammer at the handle, and thus by reducing the application pressure. In this case, it is desirable for the hammer to go into no-load operation immediately, i.e. without a time delay, in order to avoid undesired vibrations of the hammer. Correspondingly, the valve should enable an opening of the no-load channel and ventilation of the air spring as immediately as possible.

For the closing, in contrast, in a particularly advantageous specific embodiment of the present invention the time delay, i.e. the period of time during which the valve is closed, is dimensioned such that it extends over a span of time of several impact cycles, each comprising a back-and-forth movement of the drive piston. For this purpose, it is useful if the valve changes its position essentially continuously during the span of time defined by the time delay, i.e. closes the no-load channel smoothly, in order to achieve the desired smooth transition from no-load operation to percussion operation.

As a control quantity, and thus as a criterion for distinguishing between no-load operation and percussion operation, various quantities are suitable, which can be evaluated alternatively or also in combined fashion.

Thus, for example as a control quantity the position of a tool that is acted on by the hammer and/or the position of the percussion piston and/or of a rivet header (intermediate piston) can be taken into account. If, in no-load operation, the hammer is lifted off the stone that is to be worked, the shaft of the tool slides somewhat out of the tool mount of the hammer, thus reaching a forward (relative to the work direction) position. Correspondingly, the rivet header and the percussion piston can also slide forward into a position that can never be reached in percussion operation. The acquisition device is preferably then fashioned so that it is capable of recognizing this forward position and evaluating it as a criterion for no-load operation.

In another specific embodiment of the present invention, as a control quantity the position of an actuating element that controls a drive of the drive piston and that can be manipulated by the operator is used. The actuating element can be for example a gas handle or gas lever in a pressurized air hammer, capable of being moved between an open position and a closed position. The term "actuating element" can also refer to a gas pedal for an internal combustion engine, or to an operating button for an electric motor.

In a particularly advantageous specific embodiment of the present invention, the application force that can be applied by the operator is evaluated as a control quantity. For this purpose, in the flow of force between a grip point of a handle at which the operator grips or applies pressure to the hammer and a hammer housing in which at least the pneumatic spring percussion mechanism, but generally also the drive, is housed, there is situated an acquisition device for the acquisition of a pressure force that is applied to the handle by the operator and that acts as a control quantity. The valve can be opened and closed dependent on the acquired application force, and in each case the valve assumes a predefined position corresponding to the application force. In particular when a specified boundary value for the application force is exceeded, the valve moves into the closed position, so that the percussion operation of the pneumatic spring percussion mechanism can begin. If, in contrast, the boundary value is undershot, the valve opens the no-load channel, so that the air spring in the percussion mechanism is ventilated and percussion operation is interrupted.

According to the present invention, via the delay device the valve can be controlled during closing in such a way that it reaches the position corresponding to the acquired application force with a time delay.

In a particularly advantageous specific embodiment of the present invention, the handle at which the operator applies the application force is capable of being moved relative to the hammer housing. The delay device brings it about that the relative movement between the hammer housing and the handle does not result immediately in an immediate closing of the no-load channel, but rather results in a slow change in the cross-section of the no-load channel, i.e., a temporally delayed reduction and finally closing of the no-load channel.

Here, between the handle and the hammer housing there can be provided a spring system associated with the acquisition device in order to provide the handle with a pre-tension, with a prespecified spring force, relative to the hammer housing. The displacement of the handle relative to the hammer housing is then essentially proportional to the force applied by the operator.

In a particularly advantageous specific embodiment of the present invention, an axially movable sleeve is provided that forms a control element of the valve, and whose axial position is capable of being modified dependent on the application force. The design of this sleeve corresponds to that of a sleeve known from DE 101 45 464 A1. However, according to the present invention the sleeve is connected to the handle only in an axial direction, in such a way (e.g. with a positive fit) that a reduction of the application force on the part of the operator brings about an immediate and proportional change in the position of the valve.

Differing from DE 101 45 464 A1, in the present invention the sleeve is connected to the handle in the other, oppositely oriented axial direction not with a positive fit, but rather is coupled thereto in such a way that an increase in the application force, and a concomitant shifting of the handle relative to the hammer housing, brings about, via the delay device, a temporally delayed or temporally extended shifting of the sleeve. Here, "temporally delayed" or "extended" shifting is to be understood as meaning that the sleeve moves with a speed that is essentially lower than the relative speed between the handle and the hammer housing.

In a particularly advantageous specific embodiment of the present invention, the drive piston has a hollow construction, and the impact piston is capable of movement in the drive piston. In a cylindrical wall of the drive piston, at least one opening is provided that, depending on the axial position of the drive piston, can form a part of the no-load channel. The drive piston is surrounded by a percussion mechanism tube in which at least one radial opening, allocated to the opening in the wall of the drive piston, is provided, which likewise forms a part of the no-load channel. The percussion mechanism tube in turn is surrounded by the above-described sleeve, which has a radial opening allocated to the radial opening of the percussion mechanism tube.

According to the present invention, the sleeve is capable of being axially displaced on the percussion mechanism tube against the action of a spring device in such a way that in order to open the valve the radial opening of the sleeve is capable of being moved over the radial opening of the percussion mechanism tube, while in order to close the valve the sleeve covers the radial opening of the percussion mechanism tube. Here, the spring device presses the sleeve into the closed position, so that in order to open the valve the sleeve has to be displaced against the action of the spring device.

In a particularly advantageous manner, the delay device has a hollow space, formed between the sleeve and the percussion mechanism tube, whose volume changes dependent on the relative position of the percussion mechanism tube and the sleeve. The hollow space is essentially sealed off from its surrounding environment, and is continuously connected to the surrounding environment only via a defined delay opening. The delay opening is dimensioned such that it ensures a prespecified air volume stream that depends essentially on the pressure difference between the hollow space and the surrounding environment.

In addition, the hollow space can have a non-return valve that provides an additional opening via which an excess air pressure existing in the hollow space can be dismantled as needed. In contrast, air cannot flow into the hollow space via the non-return valve.

Particularly advantageously, when the operator increases the application force the valve is moved in such a way that the volume of the hollow space is enlarged by the action of the spring device and the movement of the sleeve, while the speed of movement of the sleeve is defined or limited by the prespecified air volume stream via the delay opening. In particular, the movement speed is lower than the relative speed, brought about by the application force, between the handle and the hammer housing. The sleeve can thus move only relatively slowly into the target position determined by the applied force. Because the sleeve acts as a control element for the valve, the valve also reaches its prespecified end position, defined by the applied force, with a time delay, this position essentially bringing about a completely closed position of the no-load channel.

Thus, a gentle closing of the no-load channel is ensured, so that inside the pneumatic spring percussion mechanism the air spring is built up only slowly, thus achieving the desired soft startup of the hammer.

In contrast, when the hammer is lifted, a more rapid transition from percussion operation to no-load operation is desirable. The vibration decoupling device moves the handle, now relieved of stress (mostly through the spring action), into its defined initial or rest position. The sleeve coupled to the handle then moves in such a way that the volume of the hollow space between the sleeve and the percussion mechanism tube is reduced, so that an increased air pressure arises in the hollow space. At least a part of the air situated in the hollow space can flow out via the non-return valve. Another, though generally smaller, part will also flow out of the hollow space via the delay opening. In any case, in this way it is possible for the speed of movement of the sleeve to correspond essentially to the relative speed, caused by the vibration decoupling device, between the handle and the hammer housing. This is also ensured in that when this direction of movement takes place there is a positive coupling between the sleeve and the handle.

In another specific embodiment of the present invention, the acquisition device has a sensor for the acquisition of a state in which the handle is pressed against, the hammer housing against the action of the spring system, and in order to produce a corresponding pressure signal. The valve can have a valve element that can be controlled mechanically, electrically, electromechanically, or electromagnetically. The pressure signal can be supplied to a control device that correspondingly controls the valve element for the opening and closing of the valve, the closing of the valve being extended over a particular span of time. The control device this ensures that the closing of the valve, i.e. the transition from no-load operation to percussion operation, does not take place suddenly, over a very short span of time, but rather takes place over a longer, prespecified span of time. In this way, the same effects can be achieved as in the purely mechanical solution described above.

Preferably, the sensor is fashioned as a proximity sensor or as a force measurement sensor.

In addition, it can be advantageous if a position sensor is provided in order to acquire the position of the hammer in space relative to a horizontal plane and in order to produce a corresponding position signal that can be supplied to the control device. The control device then controls the valve element using the evaluation of the pressure signal and of the position signal. Here, a deviation of the position of the hammer from the horizontal plane can be taken into account in such a way that the resulting pressure signal is subjected to a correction, taking into account the effective weights of the handle, of the hammer housing, and of the components contained therein, as well as of a tool.

Insofar as the position of the tool, of the percussion piston, and/or of the rivet header is evaluated as a control quantity, it is advantageous if a forward position (relative to a working direction) of the tool, of the rivet header, and/or of the percussion piston is used as a criterion for no-load operation, while a position situated further to the rear (relative to the forward position) is used as a criterion for percussion operation. In no-load operation, the tool (chisel), the rivet header and the percussion piston slide somewhat out of the hammer, thus reaching a no-load position that can never be reached during percussion operation. Thus, the position of the tool, of the rivet header, and of the percussion piston is a suitable criterion for distinguishing no-load operation from percussion operation.

In a particularly simple embodiment, the acquisition device includes a device for determining the position of the tool, of the rivet header, and/or of the percussion piston at least two points, one of which can be allocated to no-load operation while the other can be allocated to percussion operation. Correspondingly, it is not necessary to acquire each arbitrary position of the tool, of the rivet header, or of the percussion piston and to provide an uninterrupted, continuous monitoring. Rather, it is sufficient to determine whether the relative components have crossed a boundary between no-load operation and percussion operation. This can be realized in a particularly simple manner if the position of the components is acquired at the two points that are separated by the imaginary boundary.

In another specific embodiment of the present invention, a no-load position of the actuating element for the drive (e.g. gas handle) is used as a criterion for no-load operation, while an operating position of the actuating element is used as a criterion for percussion operation. In this way, the position of the actuating element, e.g. in a pneumatic air hammer, is easily evaluated in order to permit the inference of no-load and percussion operation.

It is particularly advantageous if the acquisition device has a sensor for acquiring the control quantity and for producing a control signal, and the valve has a valve element that can be controlled mechanically, electrically, electromechanically, or electromagnetically. The control signal can then be supplied to a control unit that correspondingly controls the valve element for the opening and closing of the valve, the closing of the valve being extended over a particular span of time in the provided manner. In this way, independent of the largely purely mechanical solution described above, a mechatronic, electrical, or electronic variant can also be realized.

Because the closing of the valve can be controlled electronically, the electronics can also be used to define the time span required for the closing. Here, the acquisition device can also determine whether the operator is at first pressing only lightly on the hammer, and thus not yet calling for full impact power. With the aid of the control electronics, it is then possible to maintain intermediate states when opening and closing the valve as long as the operator is manipulating the hammer in the corresponding manner, e.g. is pressing on it.

These and additional advantages and features of the present invention are explained in more detail below with the aid of the accompanying Figures.

DETAILED DESCRIPTION OF THE PREFERRED EMBODIMENT

Figures 1A, 1C:
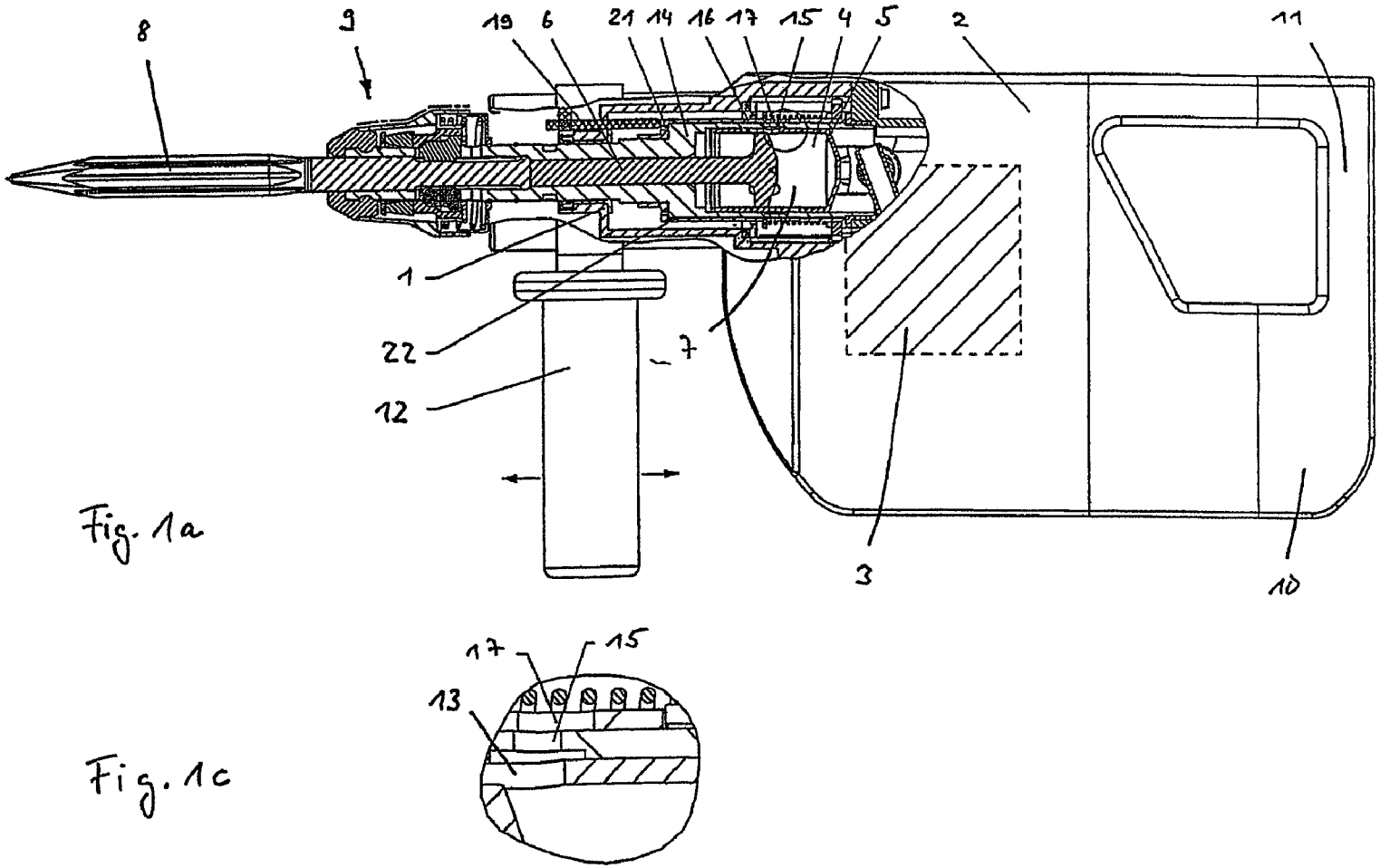
FIG. 1*a* shows a partial section through a drilling and/or percussive hammer according to the present invention in no-load operation.
FIG. 1*c* shows another detail enlargement of FIG. 1*a;*

FIG. 1*a* shows a drilling and/or percussive hammer, designated "hammer," having a hammer housing 1 and a handle cover 2 that surrounds large parts of hammer housing 1.

The term "hammer housing" 1 groups together a plurality of assemblies of the hammer, namely in particular a drive (not shown), a wobble finger mechanism 3 driven by the drive, and a pneumatic spring percussion mechanism 4. In pneumatic spring percussion mechanism 4, a drive piston 5 is set into axial back-and-forth motion by wobble finger mechanism 3, causing a percussion piston 6, also capable of back-and-forth motion in a hollow recess of drive piston 5, to be driven back and forth via an air spring formed in a hollow space 7. Percussion piston 6 in turn cyclically strikes the inserted end of a tool 8 (in FIG. 1*a*, this is a breaking chisel) that is held by a tool holding fixture 9.

Hammer housing 1 accommodates at least some of the above-named components and is standardly made of metal. It is surrounded in essential parts by handle cover 2, which is connected to hammer housing 1 via a known vibration decoupling device (not shown), e.g. via rubber cushions. Handle cover 2 can be made of plastic and can extend forward into the area of tool holding fixture 9.

On handle cover 2 there is provided a handle 10 having a grip point 11 at which the operator can hold the handle and press it against the stone that is to be worked.

In a front area of handle cover 2, another handle 12 is additionally provided that the operator can grasp with his other hand in a known manner for the better guiding of the hammer.

As described above, handle cover 2 surrounds essential parts of hammer housing 1. Of course, variants are also possible in which handle cover 2 surrounds only a part of the hammer housing, in particular the rear part of hammer housing 1, oriented towards handle 10. Likewise, it is possible for handle cover 2 not to surround hammer housing 1 at all, but rather to be held behind hammer housing 1 by the vibration decoupling device. The term "handle cover" is therefore not to be interpreted as meaning that hammer housing 1 must be enclosed by this component.

The vibration decoupling device situated between handle cover 2 and hammer housing 1 is used to keep the impacts and vibrations that occur during the production of impacts by pneumatic spring percussion mechanism 4, and during the working of the stone, away from handle cover 2 and thus away from handle 10, in order to expose the operator to the damaging vibrations as little as possible. The vibration decoupling device ensures that handle cover 2 is capable of movement relative to hammer housing 1. As can be seen immediately, for this purpose handle 10 can be pressed against hammer housing 1 by the operator in such a way that handle cover 2 is moved forward over hammer housing 1, in the direction of tool 8.

DE 101 45 464 A1 specifies that when a particular application force is applied, it is ensured that pneumatic spring percussion mechanism 4 changes from a no-load operating mode, in which hollow space 7 is connected to the surrounding environment and the air spring situated therein is ventilated, to a percussion operating mode, in which hollow space 7 is insulated from the surrounding environment so that the air spring can form in the desired manner.

For the acquisition of the application pressure that can be applied to handle 10 or to grip point 11 by the operator, an acquisition device is provided. In the specific embodiment shown in the Figures, the acquisition device consists in that the application force against the action of a spring device in the vibration decoupling device brings about a certain displacement of handle cover 2 relative to hammer housing 1. Since the spring characteristic of the vibration decoupling device is known, it can reliably be inferred that a particular application force will also bring about a particular displacement. In this way, it is also possible for the displacement to be limited by a stop, a force being required to reach the stop that corresponds to a minimum required application force for percussion operation.

Figure 1B:
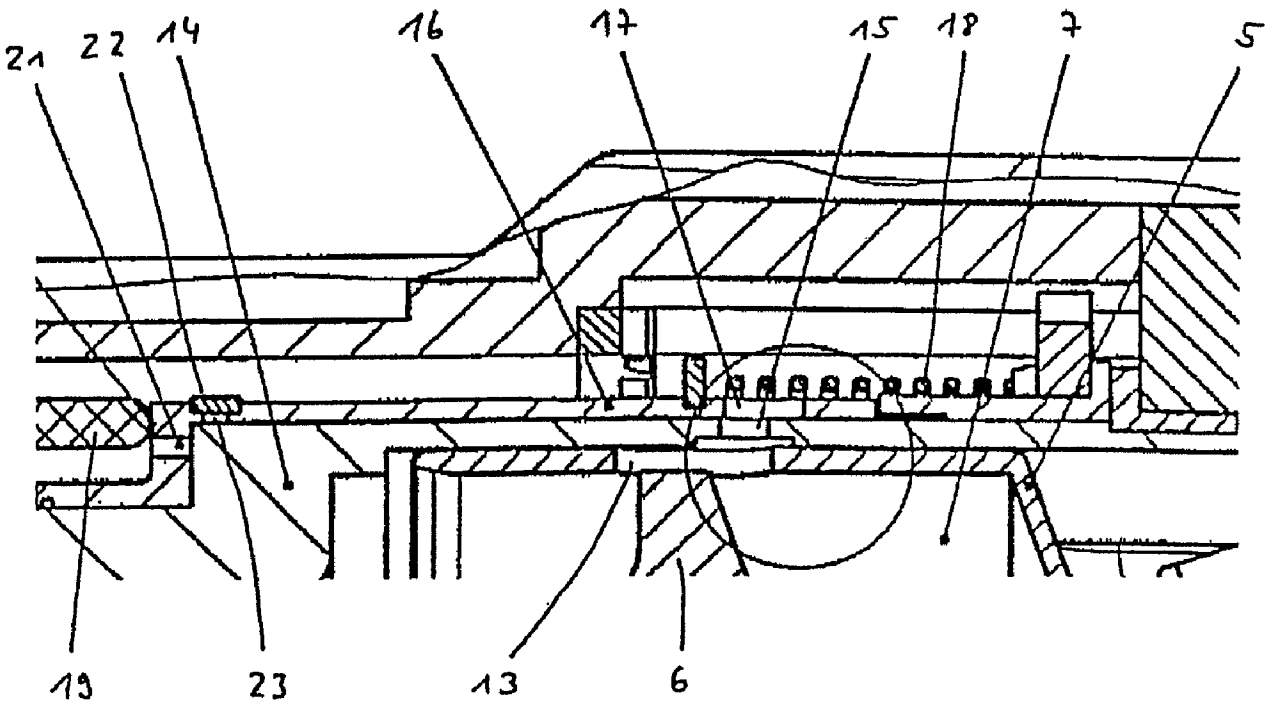
FIG. 1*b* shows a detail enlargement of FIG. 1*a;*

FIGS. 1*a* to 1*c* show the hammer in the no-load position when hollow space 7 is connected to its surrounding environment, i.e. is ventilated. The precise construction can be better seen in detail enlargements 1*b* and 1*c*.

In a cylindrical wall of drive piston 5, an opening 13 is provided in the form of a longitudinal slot. Drive piston 5 is guided radially by a percussion mechanism tube 14 that has a radial opening 15 that corresponds to opening 13 of drive piston 5.

Percussion mechanism tube 14 is surrounded by a sleeve 16 in whose wall there is fashioned a radial opening 17 that corresponds to radial opening 15 of percussion mechanism tube 14. As can be seen in FIGS. 1*b* and 1*c*, opening 13 and radial openings 15 and 17 are aligned with one another in such a way that they form a no-load channel via which hollow space 7 is brought into connection with the environment surrounding pneumatic spring percussion mechanism 5. Correspondingly, when there is an axial movement of drive piston 3 no air spring can form in hollow space 7, so that percussion piston 6 does not tend to follow the movement of drive piston 5. Pneumatic spring percussion mechanism 4 then also runs in no-load operation when drive piston 5 moves back-and-forth due to the action of the drive.

Sleeve 16 is capable of being displaced on percussion mechanism tube 14 against the action of a spring 18 so that radial opening 17 can either, in no-load operation, be situated over radial opening 15, or, as is explained below on the basis of FIGS. 2*b* and 2*c*, can be displaced in percussion operation in such a way that radial opening 17 is no longer situated over radial opening 15, so that radial opening 15 is closed by sleeve 16. Correspondingly, sleeve 16 represents a valve for the no-load channel.

The axial position of sleeve 16 is determined on the one hand by the action of spring 18. On the other hand, sleeve 16 is supported at an end surface by a pin 19 that is in turn held by handle cover 2.

Figure 2A:
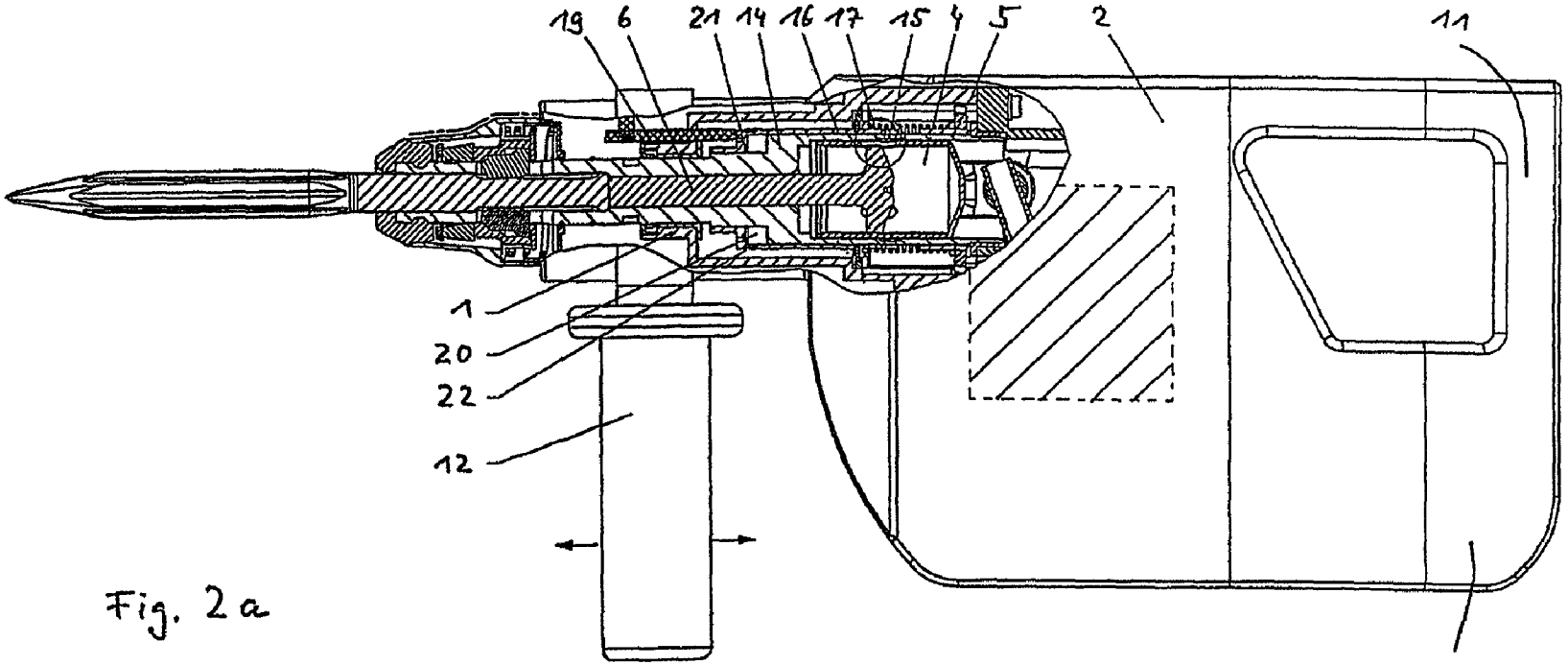
FIG. 2*a* shows a partial section, corresponding to FIG. 1*a*, of the drilling and/or percussive hammer in the impact position.
Figure 2C:
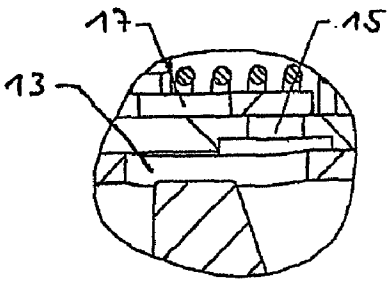
FIG. 2*c* shows another detail enlargement of FIG. 2*a*.
Figure 2B:
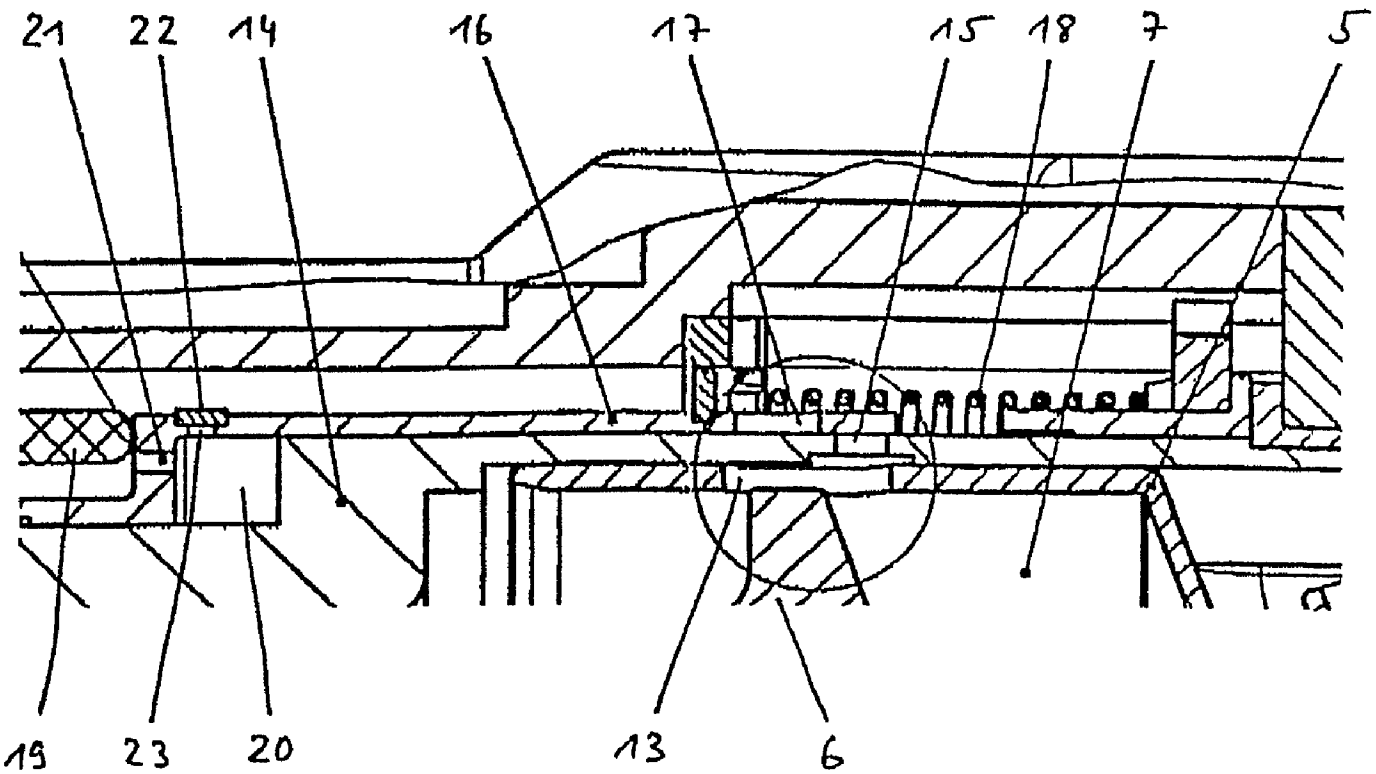
FIG. 2*b* shows a detail enlargement of FIG. 2*a;*

FIGS. 2*a* to 2*c* show the same drilling hammer, but this time in a percussion position, in which the operator applies a force against handle 10, so that handle cover 2 is displaced forward, in the direction of tool 8 relative to hammer housing 1.

A comparison of FIGS. 1*a* and 1*b* to FIGS. 2*a* and 2*b* illustrates the effect on the position of sleeve 16.

In the no-load position according to FIGS. 1*a* and 1*b*, the operator applies no force, or only a slight force, to handle 10. In some circumstances, he may even lift the hammer up by handle 10. The vibration decoupling device (not shown) ensures that handle cover 2 will assume the no-load position (initial position or idle position) shown in FIG. 1*a* relative to hammer housing 1. In this way, pin 19 presses sleeve 16 against the action of spring 18 into the position that can be seen in particular in FIG. 1*b*, so that the no-load channel is opened and the air spring in hollow space 7 is ventilated. The action of spring 18 is outweighed by the stronger force action of the vibration decoupling device.

If, in contrast, the operator applies a force to handle 10, and handle cover 2 is correspondingly displaced forward, pin 19 fastened to handle cover 2 also travels forward. At first the end-side support of sleeve 16 is missing, so that sleeve 16 is also pressed forward due to the action of spring 18, as can be seen in particular in FIG. 2*b*. Here, a hollow space 20 forms between percussion mechanism tube 14 and sleeve 16, in particular between their end surfaces. Because hollow space 20 is essentially sealed off from the surrounding environment, a partial vacuum arises in the space due to the action of spring 18. The vacuum in hollow space 20 can be dismantled only via a delay opening 21 fashioned in the end surface of sleeve 16, via which air flows into hollow space 20. Given a corresponding dimensioning of delay opening 21, this means that sleeve 16 can move only relatively slowly from the no-load position shown in FIG. 1*b* into the percussion position shown in FIG. 2*b*. Correspondingly, radial opening 17 also moves only slowly away from radial opening 15, so that the no-load channel is closed slowly. This means that the transition from no-load operation to percussion operation takes place very gently, in a manner that can easily be anticipated and controlled by the operator.

Pin 19 can thus move away from sleeve 16 given a correspondingly rapid and forceful application of pressure to handle cover 2 by the operator. The operator then defines only the end position that can be reached by sleeve 16, after which it has moved with a time delay in the direction of pin 19. The time delay, i.e. the slowed axial movement of sleeve 16, can be preselected in a suitable manner via the dimensioning of delay opening 21.

The present invention thus indicates a delay device that consists essentially of spring 18, hollow space 20, and delay opening 21.

After the work is finished, i.e. the hammer has been lifted from the stone being worked or the application force is no longer applied, in contrast a transition from percussion operation to no-load operation that is as fast as possible is desirable in order to protect the operator from undesirable vibrations. For this purpose, radial opening 17 must again be moved over radial opening 15 in order to open the no-load channel. Because here the air in hollow space 20 would form an air spring that would work against this movement, it is necessary for the supply of air in hollow space 20 to be able to be dismantled very quickly. For this purpose, a non-return valve 22 is provided that covers an opening 23 situated under it. For example, non-return valve 22 can be a rubber ring that is set into a peripheral groove and that covers a plurality of openings 23 distributed on the periphery. When the air pressure inside hollow space 20 is increased, the rubber ring of non-return valve 22 is lifted up, so that the air can escape very quickly via openings 23. In this way, a rapid transition to no-load operation is ensured.

The above-described delay device has the effect that a relative movement between the non-cushioned hammer mass (essentially hammer housing 1 with the components contained therein) and the cushioned hammer mass (essentially handle cover 2 or handle 10) does not result immediately in an instantaneous change of the cross-sections in the no-load channel, but rather brings about a deliberate time delay or temporal extension. Using such a device, depending on the force applied by the operator the hammer can be held arbitrarily long in a state of reduced impact strength with the full number of hammer impacts. Thus, the operator can keep the drive at full rotational speed so that the percussion mechanism operates with the normal operating frequency without exerting strong impacts on tool 8. However, when there is a sudden, rapid pressing of the hammer against the stone to be worked, the percussion mechanism will not make the transition to percussion operation equally quickly, but rather, due to the delay device, will require a few impact cycles before the full impact strength is reached.

The above example represents only one specific embodiment of the present invention. Of course, additional embodiments of the present invention are also possible. In particular, the increasing of the application force can also be acquired by an electric or electronic acquisition device that communicates a corresponding signal to a control device that controls a valve for the opening and closing of the no-load channel.

Here, the position of the hammer can also be taken into account, because the application force to be applied by the operator varies considerably dependent on the position of the hammer. Thus, the operator has to, apply a greater force when working horizontally or when working overhead than when working downward, because in the former cases the weight of the hammer also has to be supported. The resulting application forces and the corresponding consequences for the change between no-load operation and percussion operation can be evaluated or set by the control device in a suitable manner.

Figure 3:
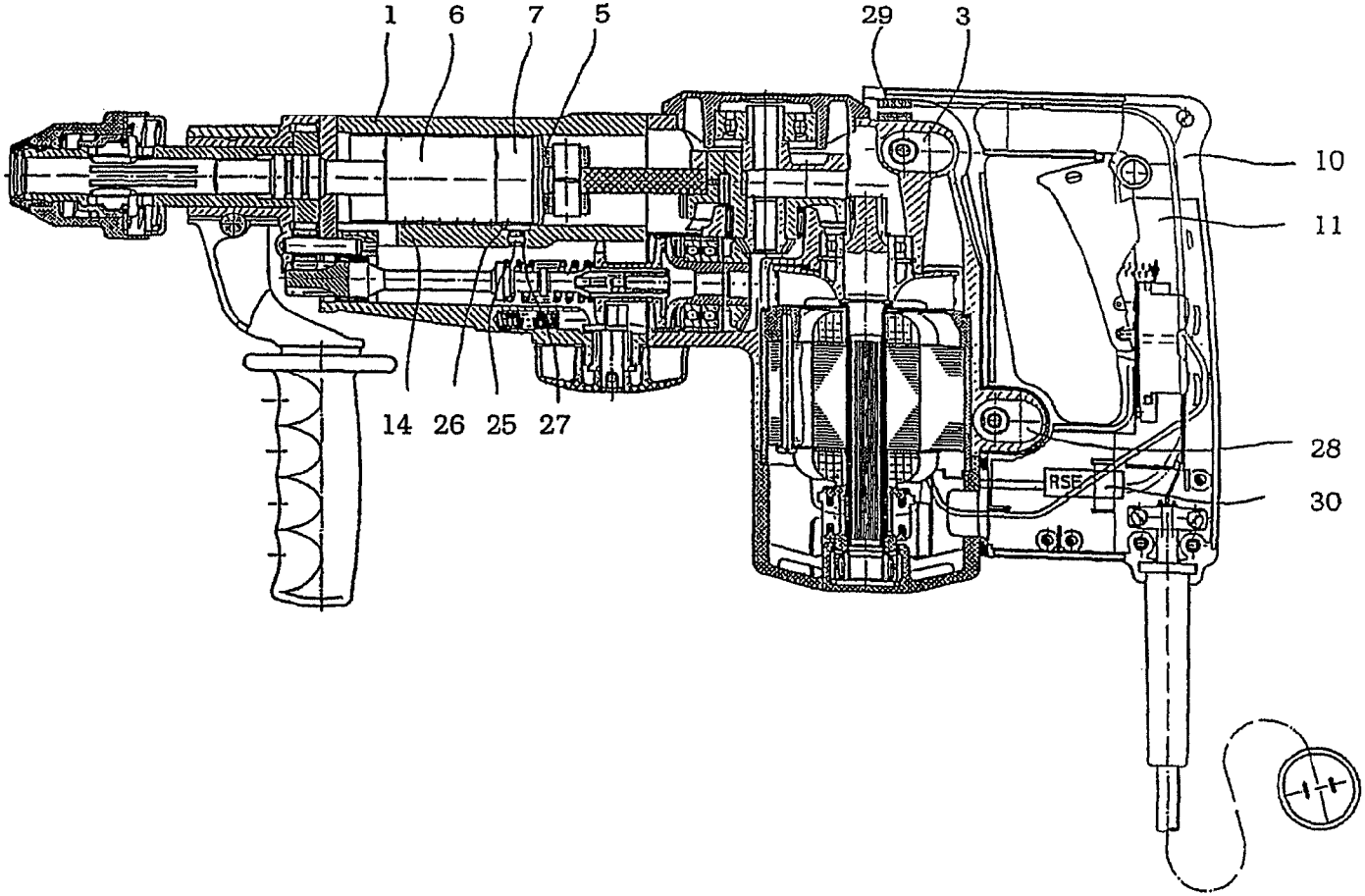
FIG. 3 shows a section through another specific embodiment of a drilling and/or percussive hammer according to the present invention.

FIG. 3 shows a section through another specific embodiment of the drilling hammer according to the present invention that is based on the representation according to FIG. 4 from DE 101 45 464 A1. In DE 101 45 464 A1, with reference to this Figure a hammer is described in which a recognition of the force applied by the operator at the handle, and a resulting influencing of the position of the valve that controls the connection of hollow space 7 to the surrounding environment, takes place mechatronically.

For this purpose, a valve element 25 is set into a very short no-load channel. Here, the no-load channel is made up only of a recess 26 in percussion mechanism tube 14 and a connecting channel 27 in which valve element 25 is placed. Valve element 25 has in its interior a through-hole, and can be rotated by an actuating element not shown in the Figure. In FIG. 3, valve element 25 is rotated into a position in which the through-hole is not situated in the no-load channel, so that the connection between hollow space 7 and the surrounding environment of the pneumatic spring percussion mechanism is interrupted. However, valve element 25 can be rotated by 90° into a position in which the through-hole opens the no-load channel and creates the connection between hollow space 7 and the surrounding environment.

Handle 10 is fastened so as to be capable of movement relative to hammer housing 1, against the action of spring systems 28. The relative position between handle 10 and hammer housing 1 is acquired using a proximity sensor 29. Proximity sensor 29 can be designed so that it is able to distinguish only binary states, namely percussion operation and no-load operation, or, alternatively, with the aid of a suitable proximity sensor it is possible to acquire the precise position of handle 10 relative to hammer housing 1 and to evaluate it correspondingly. Instead of proximity sensor 29 it is also possible to situate a suitable force measuring sensor, e.g. inside spring systems 28 or also independently of spring systems, that acquires the force applied by the operator. In addition, it is possible to use a touch-sensitive force measuring sensor in handle 10 itself to directly acquire the force applied to grip point 11 by the operator.

Proximity sensor 29 produces a pressure signal that corresponds to the application force, whether it be binary or proportional to the application force, and communicates it to a control device 30. If control device 30 recognizes that the operator is pressing on the hammer in such a way that a transition from no-load operation to percussion operation is desired, control device 30 controls the valve actuating element (not shown) in order to rotate valve element 25 into the position shown in FIG. 3. When the hammer is lifted, and the application force is correspondingly relaxed, the reverse process is introduced.

In particular when valve element 25 is rotated into the percussion position in order to close no-load channel 27, according to the present invention a certain time delay is to be achieved. This means that control device 30 includes the delay device, and controls the valve actuating element in such a way that the desired temporally extended transition can be achieved.

In other specific embodiments of the present invention, quantities other than the force applied by the operator can be evaluated as the control quantity. These include in particular the position of tool 8, the position of percussion piston 6, or the position of a rivet header (not shown in the Figures) that acts as an intermediate piston between percussion piston 6 and tool 8. Here, it is not required to acquire the position precisely in each case. The essential thing is to determine a change of the position between the percussion position and the no-load position, and to determine therefrom whether the hammer is in no-load operation or in percussion operation. Thus, it is also not necessary for the position to be determined exactly. Rather, it is sufficient if the location of the relevant component whose position is to be determined is acquired within a certain range.

The invention claimed is:

1. A drilling and/or impact hammer, comprising:

a pneumatic spring percussion mechanism having a drive piston that is capable of being moved back and forth, and having a percussion piston that is capable of being driven by the drive piston, a hollow space for accommodating an air spring being formed between the drive piston and the percussion piston;

a no-load channel for connecting the hollow space to the surrounding environment of the pneumatic spring percussion mechanism and for ventilating the hollow space in a no-load operating state;

a valve that is situated in the no-load channel for opening the no-load channel in the no-load operating state and for closing the no-load channel in a percussion operating state;

an acquisition device for acquiring a control quantity that distinguishes percussion operation and no-load operation;

the valve being capable of being opened and closed dependent on the control quantity, and for this purpose assuming a position corresponding to the control quantity; and a delay device via which the valve is capable of being controlled during closing in such a way that it reaches the position corresponding to the acquired control quantity with a time delay, and wherein the time delay is dimensioned such that it extends over a time span of several impact cycles, each comprising a back-and-forth movement of the drive piston.

2. The drilling and/or percussive hammer as recited in claim 1, wherein, during opening, the valve is capable of being controlled in such a way that it essentially immediately reaches a position corresponding to the acquired control quantity.

3. The drilling and/or percussive hammer as recited in claim 1, wherein the valve essentially continuously changes its position during the time span defined by the time delay.

4. The drilling and/or percussive hammer as recited in claim 1, wherein the control quantity is a quantity selected from the group consisting of:

a pressure force that can be applied by an operator, a position of a tool, a position of the percussion piston, and a position of a rivet header, a position of an actuating element that can be manipulated by the operator and that controls a drive of the drive piston.

5. The drilling and/or percussive hammer as recited in claim 4, wherein a front position, relative to a working direction of at least one of the tool, of the rivet header, and of the percussion piston is used as a criterion for no-load operation, while a position that is displaced towards the rear relative to the front position of at least one of the tool, of the rivet header, and of the percussion piston is used as a criterion for percussion operation.

6. The drilling and/or percussive hammer as recited in one of claim 4, wherein the acquisition device has a device for determining the position of at least one of the tool, of the rivet header, and the percussion piston at least two points, the one point being capable of being allocated to no-load operation and the other point being capable of being allocated to percussion operation.

7. The drilling and/or percussive hammer as recited in one of claim 1, wherein at least one handle is provided with a grip point so that the operator can hold and press on the drilling and/or percussive hammer;

the control quantity is a pressure force that can be applied to the handle by the operator;

at least the pneumatic spring percussion mechanism is surrounded by a hammer housing;

the acquisition device for acquiring the applied force is situated in the flow of force between the grip point and the hammer housing;

the valve is capable of being opened and closed dependent on the acquired applied force, and for this purpose assumes a position corresponding to the applied force; and wherein via the delay device, the valve can be controlled during closing in such a way that it reaches the position corresponding to the acquired applied force with the time delay.

8. The drilling and/or percussive hammer as recited in claim 7, wherein, by increasing the applied force, a transition from no-load operation to percussion operation is brought about, and by reducing the applied force, a transition from percussion operation to no-load operation is brought about.

9. The drilling and/or percussive hammer as recited in claim 7, wherein the handle is capable of being moved relative to the hammer housing.

10. The drilling and/or percussive hammer as recited in claim 9, wherein, between the handle and the hammer housing, there is provided a spring system that is part of the acquisition device and that holds handle relative to the hammer housing with a prespecified spring force.

11. The drilling and/or percussive hammer as recited in claim 10, wherein the acquisition device has a stop that is coupled to the handle and that is capable of being displaced with the handle relative to the hammer housing, against the action of the spring system, in such a way that its displacement is essentially proportional to the force applied by the operator.

12. The drilling and/or percussive hammer as recited in claim 10, wherein the spring system is also a component of a device for vibration after decoupling of the handle from the pneumatic spring percussion mechanism.

13. The drilling and/or percussive hammer as recited in claim 7, wherein the acquisition device has a sensor for acquiring a state in which the handle is pressed against the hammer housing against the action of the spring system, and for producing a pressure signal;

the valve has a valve element that is capable of being controlled at least one of mechanically, electrically, electromechanically, or electromagnetically, and wherein the pressure signal is capable of being supplied to a control device that correspondingly controls the valve element in order to open and close the valve, the closing of the valve being extended over a particular span of time.

14. The drilling and/or percussive hammer as recited in claim 13, wherein the sensor is a proximity sensor or a force measuring sensor.

15. The drilling and/or percussive hammer as recited in claim 13, wherein a position sensor is provided for acquiring the position of the drilling and/or percussive hammer in space relative to a horizontal plane and for producing a corresponding position signal;

the position signal is capable of being supplied to the control unit; and wherein by evaluating the pressure signal and the position signal, the control unit controls the valve element.

16. The drilling and/or percussive hammer as recited in claim 15, wherein, while the evaluation of the pressure signal and of the position signal, a deviation of the position of the drilling and/or percussive hammer from the horizontal plane is capable of being taken into account in such a way that the resulting pressure signal is capable of being subjected to a correction taking into account the effective weights of the handle, of the hammer housing, and of the components contained therein, as well as of a tool.

17. The drilling and/or percussive hammer as recited in one of claim 7, wherein a no-load position of the handle is used as a criterion for no-load operation, while an operating position of the handle is used as a criterion for percussion operation.

18. The drilling and/or percussive hammer as recited in claim 1, wherein the control quantity comprises an applied force by the operator, and wherein a sleeve that is capable of axial movement and that forms a control element of the valve is provided whose axial position is capable of being changed dependent on the applied force.

19. The drilling and/or percussive hammer as recited in claim 18, wherein the sleeve is connected to the handle in an axial direction in such a way that a reduction of the applied force by the operator brings about an immediate and proportional change in the position of the valve.

20. The drilling and/or percussive hammer as recited in claim 19, wherein the sleeve is coupled to the handle in the other axial direction in such a way that an increase in the applied force and a resulting displacement of the handle relative to the hammer housing brings about, via the delay device, a temporarily delayed displacement of the sleeve.

21. The drilling and/or percussive hammer as recited in claim 1, wherein the drive piston has a hollow construction;

the percussion piston is capable of being axially moved in the drive piston, and wherein in a cylindrical wall of the drive piston, there is provided at least one opening that, depending on the axial position of the drive piston, forms a part of the no-load channel.

22. The drilling and/or percussive hammer as recited in claim 21, wherein the drive piston is surrounded by a percussion mechanism tube in which at least one radial opening, allocated to the opening in drive piston, is provided that forms a part of the no-load channel.

23. The drilling and/or percussive hammer as recited in claim 22, wherein the percussion mechanism tube is surrounded by the sleeve;

the sleeve has a radial opening that is allocated to the radial opening of the percussion mechanism tube;

the sleeve is capable of being axially displaced on the percussion mechanism tube against the action of a spring device in such a way that, in order to open the valve, the radial opening of the sleeve is capable of being moved over the radial opening of the percussion mechanism tube, and in order to close the valve the sleeve covers the radial opening of the percussion mechanism tube.

24. The drilling and/or percussive hammer as recited in claim 23, wherein the spring device presses the sleeve into the closed position.

25. The drilling and/or percussive hammer as recited in claim 23, wherein the delay device has a hollow space, formed between the sleeve and the percussion mechanism tube, whose volume changes dependent on the relative position of the percussion mechanism tube and the sleeve;

the hollow space is connected to the surrounding environment via a delay opening;

the delay opening is dimensioned such that it ensures a pre-specified air volume flow.

26. The drilling and/or percussive hammer as recited in claim 25, wherein the hollow space has a non-return valve via which an excess air pressure existing in the hollow space can be dismantled.

27. The drilling and/or percussive hammer as recited in claim 25, wherein, when the applied force is increased, the sleeve moves in such a way that the volume of the hollow space is enlarged, the movement speed of the sleeve being limited by the pre-specified air volume flow via the delay opening, in particular being lower than a relative speed, brought about by the applied force, between the handle and the hammer housing.

28. The drilling and/or percussive hammer as recited in claim 25, wherein, when there is a reduction of the applied force, the sleeve moves in such a way that the volume of the hollow space is reduced, and at least a part of the air situated in the hollow space flowing flows out via the non-return valve, in such a way that the speed of movement of the sleeve corresponds essentially to the relative speed between the handle and the hammer housing.

29. The drilling and/or percussive hammer as recited in claim 1, wherein the acquisition device has a sensor for acquiring the control quantity and for producing a control signal;

the valve has a valve element that is capable of being one of controlled mechanically, electrically, electromechanically, and electromagnetically, and wherein the control signal is capable of being supplied to a control device that correspondingly controls the valve element in order to open and close the valve, the closing of the valve being extended over a certain span of time.

* * * * *